US008684068B2

(12) United States Patent
Kweon et al.

(10) Patent No.: US 8,684,068 B2
(45) Date of Patent: Apr. 1, 2014

(54) APPARATUS AND METHOD FOR CONTROLLING HORIZONTAL OSCILLATION OF AN EDGE DAM OF A TWIN ROLL STRIP CASTER

(75) Inventors: Oh-Seong Kweon, Pohang-si (KR); Kwi-Ju Hwang, Pohang-si (KR); Yoon-Ha Kim, Pohang-si (KR); Ji-Woong Jun, Pohang-si (KR); Sang-Hoon Kim, Pohang-si (KR)

(73) Assignee: Posco (KR)

( * ) Notice: Subject to any disclaimer, the term of this patent is extended or adjusted under 35 U.S.C. 154(b) by 0 days.

(21) Appl. No.: 13/513,989

(22) PCT Filed: Dec. 16, 2010

(86) PCT No.: PCT/KR2010/009005

§ 371 (c)(1),
(2), (4) Date: Jun. 5, 2012

(87) PCT Pub. No.: WO2011/081332

PCT Pub. Date: Jul. 7, 2011

(65) Prior Publication Data

US 2012/0235314 A1 Sep. 20, 2012

(30) Foreign Application Priority Data

Dec. 28, 2009 (KR) ..... 10-2009-0131829

(51) Int. Cl.
*B22D 11/06* (2006.01)
*B22D 11/16* (2006.01)

(52) U.S. Cl.
USPC ..... 164/452; 164/480; 164/428; 164/154.5

(58) Field of Classification Search
USPC ..... 164/480, 428, 452, 154.4, 154.5, 154.8
See application file for complete search history.

(56) References Cited

U.S. PATENT DOCUMENTS

| | | | | |
|---|---|---|---|---|
| 5,188,166 | A * | 2/1993 | Perry | 164/416 |
| 5,400,849 | A | 3/1995 | Sasaki et al. | |
| 5,915,454 | A | 6/1999 | Wright et al. | |

FOREIGN PATENT DOCUMENTS

| | | | |
|---|---|---|---|
| EP | 0556657 | A1 | 8/1993 |
| JP | 60184450 | A | 9/1985 |
| JP | 62016853 | A | 1/1987 |
| JP | 4228243 | A | 8/1992 |
| JP | 04228244 | A | 8/1992 |
| JP | 2000117397 | A | 4/2000 |
| KR | 20050065063 | A | 6/2005 |
| WO | 9620800 | A1 | 7/1996 |

* cited by examiner

*Primary Examiner* — Kevin P Kerns
(74) *Attorney, Agent, or Firm* — The Webb Law Firm

(57) ABSTRACT

An apparatus and method for controlling the horizontal oscillation of an edge dam of a twin roll strip caster is provided. The apparatus includes an oscillation unit which horizontally oscillates an oscillation plate in accordance with an oscillation waveform so that an edge dam refractory coupled to the oscillation plate horizontally oscillates, a servo valve which outputs the oscillation waveform to the oscillation unit, and a control unit which applies the oscillation waveform to the servo valve, thus controlling the horizontal oscillation of the oscillation unit. The amplitude, frequency and waveform of the oscillation are variably controlled depending on casting conditions. The edge dam horizontally oscillates, using the servo valve and a hydraulic cylinder, thus rapidly removing edge skull and suppressing the generation and growth of skull, thereby preventing a casting roll or edge dam from being damaged.

17 Claims, 7 Drawing Sheets

PRIOR ART PRIOR ART (a)

APPARATUS AND METHOD FOR CONTROLLING HORIZONTAL OSCILLATION OF AN EDGE DAM OF A TWIN ROLL STRIP CASTER

TECHNICAL FIELD

The present invention relates, in general, to apparatuses and methods for controlling the horizontal oscillation of edge dams of twin roll strip casters and, more particularly, to an apparatus and method for controlling the horizontal oscillation of an edge dam of a twin roll strip caster which can prevent a casting roll and the edge dam from being damaged while oscillating the edge dam to reduce edge skull.

BACKGROUND ART

Generally, twin roll strip casting is a process including supplying molten steel to two rolls that are rotating, and continuously producing a strip having a thickness of several mms directly from the molten steel.

FIG. 1 is a perspective view of a typical twin roll strip caster. FIG. 2 is of schematic views showing skull formed in an edge dam according to a conventional technique.

As shown in FIG. 1, in the typical twin roll strip caster, molten steel is uniformly supplied from a tundish into the space between two casting rolls 110 by a nozzle 120, and the casting rolls 110 rotate. Then, molten steel forms solidified layers on the surfaces of the casting rolls 110 that are being cooled, and the solidified layers unite together with each other at the closest point between the casting rolls 110, thus continuously forming a strip having a predetermined thickness.

Two edge dam refractories 150 are respectively provided on opposite ends of the pair of casting rolls 110 to prevent molten steel from flowing out of the space between the casting rolls 110. Both high temperature molten steel that has been supplied between the casting rolls 110 and the casting rolls 110 that are being cooled by water are simultaneously put in contact with the active surfaces of the edge dam refractories 150 that have been preheated before casting. Hence, of the surfaces of the edge dam refractories 150, portions that make contact with the casting rolls 110 cool rapidly, causing heat loss in the vicinity thereof, thereby forming conditions under which molten steel can easily solidify.

Therefore, as shown in FIG. 2, molten steel 131 is solidified on the active surfaces of the edge dam refractories 150, thus forming edge skull 132 and surface skull 134. Such skull grows on the surfaces of the edge dam refractories 150. Of the skull, the edge skull 132 undergoes repeated growth and removal and then becomes mixed with the edges of a casting strip 140, deteriorating the quality of the casting strip 140. In addition, when the skull hardens, it is compressed, forming lower skull 133 between the casting rolls 110, thus causing damage to the casting rolls 110, or inducing the strip to break.

In an effort to overcome the above problems, a technique of injecting an inert gas into the molten steel through the lower portion of the edge dam and preventing the molten steel from solidifying, and a technique of oscillating the edge dam refractories at a predetermined amplitude and physically removing the skull were proposed.

The inert gas injection method of the skull removal techniques is a technique in which a thin metal tube is installed on the lower portion of each edge dam refractory and an inert gas is injected into the molten steel through the metal tube, thus preventing the molten steel from solidifying, and reducing skull. This technique is comparatively effective at reducing skull of the lower portion of the edge dam, but there still remains the problems of the generation and growth of surface skull on the inner surface of the edge dam and of edge skull on junction surfaces between the casting rolls and the active surface of the edge dam.

As shown in FIG. 3, the edge dam oscillation method of the skull removal techniques is a technique which oscillates the edge dam refractories at a predetermined amplitude, thus physically removing skull. In this technique, when an oscillation motor (not shown) is operated, an eccentric shaft 330 rotates. Thereby, a slide bushing 320 comes into contact with a cover 310, thus generating oscillation. The oscillation is transmitted to an oscillation plate 300, so that as shown in FIG. 4*a*, the lower portion of the oscillation plate oscillates around a bearing 301 provided on the center of the oscillation plate in the same manner as that of a pendulum, thus oscillating the edge dam refractory 142, thereby preventing the skull from fusing with the edge dam.

However, this technique pertains to a mechanical oscillating method using an oscillation cam 302, which is fixed in amplitude. Thus, when it is necessary to change the amplitude, it is required to replace the eccentric shaft 330, an eccentric ring or others with new ones before casting, and depending on a worker, the amplitude may be different. Hence, even if edge skull forms during the casting, it is impossible to control the amplitude, forcing the casting operation to be interrupted. Moreover, because the edge dam refractory oscillates in the same manner as that of a pendulum, the upper and lower portions of the edge dam reliably oscillate, but as it becomes closer to the center of the edge dam, the amplitude reduces, and a dead zone 200 that does not oscillate is eventually formed at the center of the edge dam. In the dead zone, skull is still formed and grown, causing the problem of mixing with a casting strip. Meanwhile, although it is possible to increase the amplitude to prevent the occurrence of the dead zone, this may damage the edge dam, and fragments of the damaged edge dam may mix with a casting strip.

DISCLOSURE

Technical Problem

Accordingly, the present invention has been made keeping in mind the above problems occurring in the prior art, and an object of the present invention is to provide an apparatus and method for controlling the horizontal oscillation of an edge dam of a twin roll strip caster which can rapidly remove edge skull that is formed by stagnation and solidification of molten steel, and can effectively suppress the generation and growth of skull, thus preventing a component such as a casting roll or an edge dam from being damaged, thereby ensuring the stability of casting, and improving the quality of a casting strip.

SUMMARY OF THE INVENTION

In order to accomplish the above object, in an aspect, the present invention provides an apparatus for controlling horizontal oscillation of an edge dam of a twin roll strip caster, the apparatus including an oscillation unit horizontally oscillating an oscillation plate in accordance with an oscillation waveform so that an edge dam refractory coupled to the oscillation plate horizontally oscillates, a servo valve outputting the oscillation waveform to the oscillation unit to perform the horizontal oscillation, and a control unit applying the oscillation waveform to the servo valve, thus controlling the horizontal oscillation of the oscillation unit.

The oscillation unit may include a main body installed with a hydraulic line, a hydraulic cylinder fastened to the main body, a cylinder rod placed through the hydraulic cylinder so as to be movable to opposite sides of the hydraulic cylinder, and a support connecting opposite ends of the cylinder rod to opposite ends of the oscillation plate.

The apparatus for controlling the horizontal oscillation of the edge dam of the twin roll strip caster may further include an oscillation-unit-displacement measuring device transmitting information about a real time position of the oscillation unit to the control unit.

The control unit may include an oscillation information collector collecting from an HMI (Human Machine Interface) information about an ON/OFF status of the oscillation, and an amplitude, a frequency and a waveform of the oscillation, an oscillation waveform generator generating, using the information received from the oscillation information collector, a reference of the oscillation waveform having an amplitude and a frequency that are required to control the horizontal oscillation, and a horizontal oscillation controller controlling the servo valve both using the information about the oscillation waveform received from the oscillation waveform generator and using information about a position of the oscillation unit that is received from the oscillation-unit-displacement measuring device, thus controlling the horizontal oscillation of the oscillation unit.

The control unit may further include a ramping unit varying at constant rates the amplitude and the frequency of the reference of the oscillation waveform generated from the oscillation waveform generator.

The control unit may further include an oscillation-unit-center measuring device transmitting information about a center position of the oscillation unit to the horizontal oscillation controller.

The oscillation waveform may comprise a sine wave, a rectangular wave or a triangular wave.

The amplitude of the oscillation waveform may range from 10 μm to 1,500 μm, and the frequency may range from 0.1 Hz to 20 Hz.

In another aspect, the present invention provides a method for controlling horizontal oscillation of an edge dam of a twin roll strip caster, the method including horizontally oscillating an oscillation plate using a servo valve and a cylinder in accordance with an oscillation waveform so that an edge dam refractory coupled to the oscillation plate horizontally oscillates, thus eliminating a zone which does not oscillate, and reducing edge skull.

The horizontally oscillating may comprise horizontally oscillating the oscillation plate such that at an initial stage of casting, an amplitude of the oscillation is maintained within a range from 500 μm to 1,200 μm, and after the initial stage has passed, the amplitude is maintained within a range from 200 μm to 600 μm, and at a final stage of the casting, the amplitude is maintained within a range from 400 μm to 700 μm.

The method for controlling the horizontal oscillation of the edge dam of the twin roll strip caster may include reducing the frequency of the oscillation waveform or changing the oscillation waveform from a sine wave into a rectangular or triangular wave, thus minutely controlling the amplitude of the oscillation waveform.

The method for controlling the horizontal oscillation of the edge dam of the twin roll strip caster may include an operation of selecting information about an ON/OFF status of the oscillation, and an amplitude, a frequency and a waveform of the oscillation using an HMI (Human Machine Interface) monitor, a slow loop operation of collecting the information selected using the HMI monitor and transmitting the information to a medium loop, a medium loop operation of generating, using the information received from the slow loop, a reference of the oscillation waveform having an amplitude and a frequency that are required to control the horizontal oscillation, and transmitting the reference to a fast loop, and a fast loop operation of controlling the servo valve both using the information about the reference of the oscillation waveform received from the medium loop and using information about a position of an oscillation unit received from an oscillation-unit-displacement measuring device, thus controlling horizontal oscillation of the oscillation unit.

The medium loop operation may include varying the amplitude and frequency of the reference of the oscillation waveform at constant rates, and transmitting the information about the reference of the oscillation waveform to the fast loop.

The fast loop operation may include controlling the horizontal oscillation of the oscillation unit in a period of 0.001 or less.

The present invention variably controls the amplitude, frequency and waveform of the oscillation depending on casting conditions, and horizontally oscillates an edge dam using a servo valve and a hydraulic cylinder. Therefore, the present invention can rapidly remove edge skull and suppress generation and growth of skull, thus preventing a casting roll or the edge dam from being damaged, thereby ensuring the stability of casting, and improving the quality of a casting strip.

DETAILED DESCRIPTION OF THE INVENTION AND BEST MODE

Hereinafter, an apparatus for controlling horizontal oscillation of an edge dam of a twin roll strip caster according to the present invention will be described in detail with reference to the attached drawings.

Figure 6:
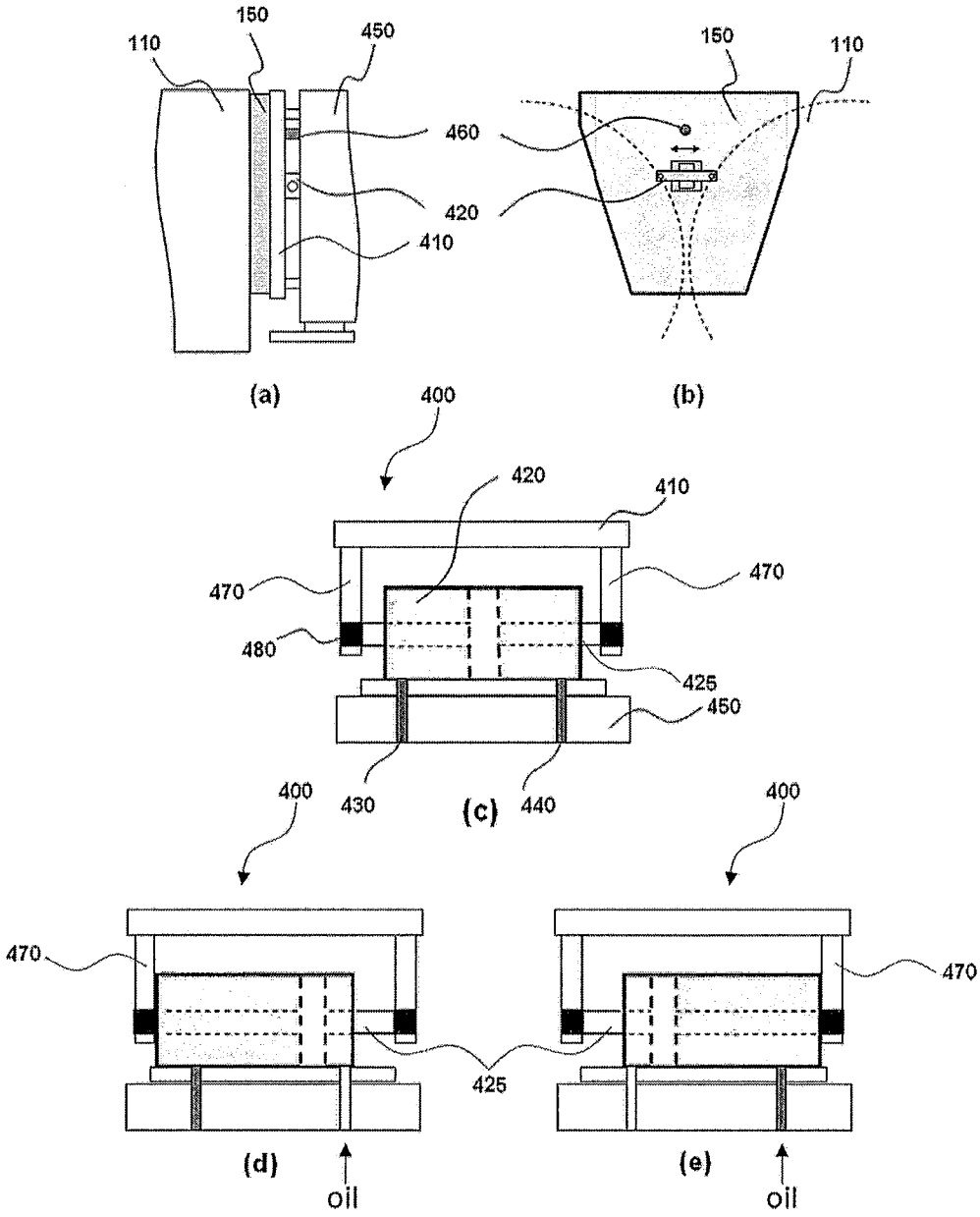
FIG. 6 is views showing the construction of an oscillation unit of an apparatus for controlling the horizontal oscillation of an edge dam, according to the present invention, wherein (a) is a plan view, (b) is a front view, (c) is a plan view, (d) is a view showing the operation when oil is drawn into a first inlet line, and (e) is a view showing the operation when oil is drawn into a second inlet line.
Figure 7:
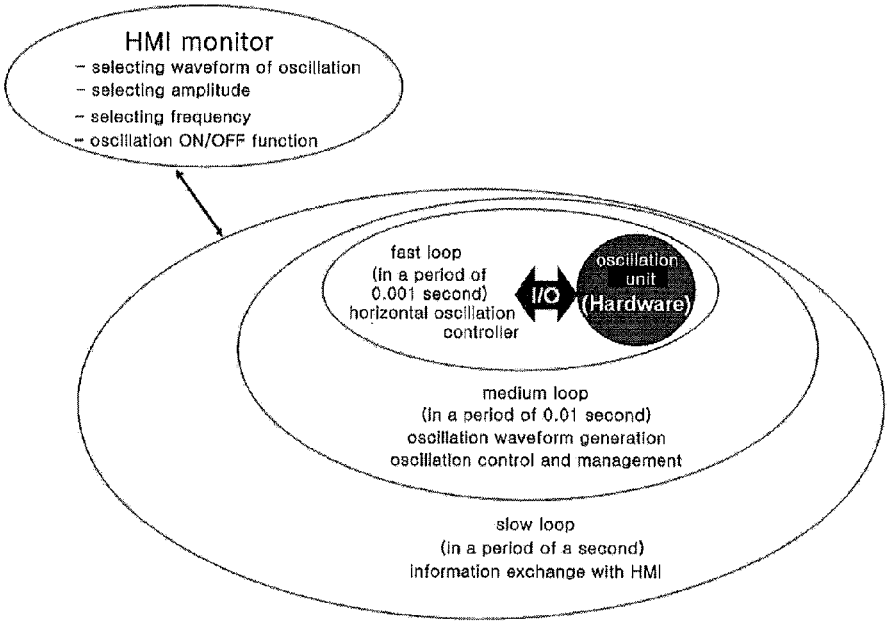
FIG. 7 is a conceptual view illustrating a method for controlling horizontal oscillation of an edge dam according to the present invention.
Figure 8:
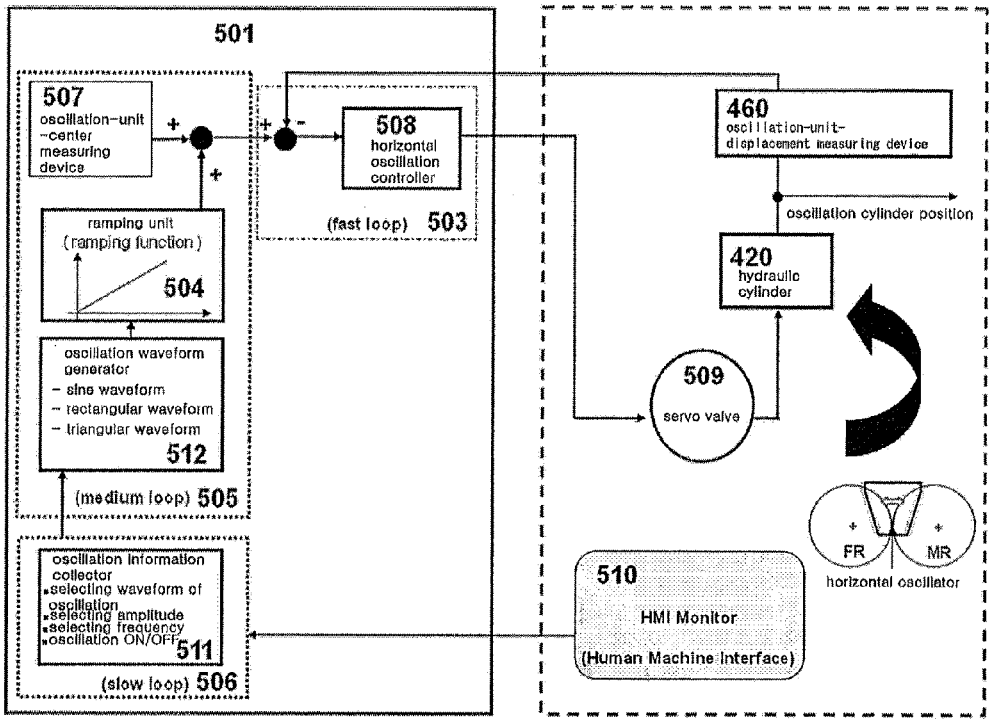
FIG. 8 is a block diagram showing the apparatus and method for controlling horizontal oscillation of the edge dam according to the present invention.

FIG. 6 is views showing the construction of an oscillation unit of the oscillation control apparatus according to the present invention, wherein (a) is a plan view, (b) is a front view, (c) is a plan view, (d) is a view showing the operation when oil is drawn into a first inlet line, and (e) is a view showing the operation when oil is drawn into a second inlet line. FIG. 7 is a conceptual view illustrating a method for controlling horizontal oscillation of the edge dam according to the present invention. FIG. 8 is a block diagram showing the apparatus and method for controlling horizontal oscillation of the edge dam according to the present invention.

As shown in FIG. 6, the oscillation control apparatus according to the present invention is configured such that an oscillation unit 400 horizontally oscillates an oscillation plate 410, which is coupled to a rear surface of an edge dam refractory 150 that is an inactive surface, in accordance with an oscillation waveform output from a servo valve 509, thus horizontally oscillating the edge dam refractory 150 coupled to the oscillation plate 410, thereby reducing edge skull.

As shown in FIG. 8, the servo valve 509 is controlled by a horizontal oscillation controller 508 of a fast loop 503 of a control unit 501. The servo valve 509 receives a waveform having a predetermined amplitude and oscillation frequency from the horizontal oscillation controller 508 and moves a cylinder rod 425 of a hydraulic cylinder 420 of the oscillation unit 400 to the left and right, thus controlling the horizontal oscillation of the edge dam refractory.

As shown in FIG. 6(*c*), the oscillation unit 400 includes a main body 450 in which the first inlet line 430 and the second inlet line 440 are formed at opposite sides. The hydraulic cylinder 420 is fastened to the main body 450. The cylinder rod 425 is placed through the hydraulic cylinder 420 and is able to be moved in both directions by the hydraulic pressure of the hydraulic cylinder 420. Further, opposite ends of the cylinder rod 425 are respectively fastened to opposite ends of the oscillation plate 400 by supports 470. Each end of the cylinder rod 425 is connected to the corresponding support 470 by a bolt passing through a bolt assembly part 480.

The oscillation control apparatus according to the present invention includes the control unit 501 which applies an oscillation waveform having a predetermined amplitude and oscillation frequency to the servo valve 509, thus controlling horizontal oscillation of the oscillation unit 400.

As shown in FIG. 8, the control unit 501 includes an oscillation information collector 511 which receives information about the ON/OFF status of the oscillating operation, and an amplitude, frequency and waveform of oscillation that are input by an operator using an HMI (Human Machine Interface) and transmits the information to a medium loop 505, or transmits a variety of feedback information from the medium loop 505 to the HMI and displays the feedback information on an HMI monitor.

Further, an oscillation waveform generator 512 of the control unit generates an oscillation waveform having an amplitude and oscillation frequency that are required to control horizontal oscillation, in response to the information received from the oscillation information collector 511. The generated oscillation waveform information is transmitted to the horizontal oscillation controller 508 of the fast loop 503.

Given information about a real-time position of the oscillation unit 400 that has been received from an oscillation-unit-displacement measuring device 460 which is coupled to the upper end of the oscillation plate 410, the horizontal oscillation controller 508 applies the oscillation waveform information from the oscillation waveform generator 512 to the servo valve 509 and controls the hydraulic pressure in the hydraulic cylinder 420 based on a positional value of a center of the oscillation unit 400 that is transmitted from an oscillation-unit-center measuring device 507, so that such control makes the edge dam refractory 150 horizontally oscillate to the left and right at high speed.

Here, the oscillation-unit-displacement measuring device 460 checks in real time the positional information of the oscillation unit 400 and transmits it to the control unit 501. The oscillation-unit-center measuring device 507 transmits the positional value of the center of the oscillation unit 400 to the horizontal oscillation controller of the fast loop 503 so that the oscillation unit 400 can horizontally oscillate to the left and right based on the center between both casting rolls 110.

The control unit 501 further includes a ramping unit 504 which smoothly varies at constantly increasing rates the amplitude and oscillation frequency of a reference of an oscillation waveform generated from the oscillation waveform generator 512 so as to prevent the apparatus from being exposed to the impacts which may be generated by drastically changing the amplitude and oscillation frequency of the reference of the oscillation waveform. In other words, the ramping unit 504 controls the reference values of the amplitude and oscillation frequency of the oscillation waveform transmitted from the oscillation waveform generator 512 such that the reference values slowly vary at a constant rate, before transmitting the reference values to the horizontal oscillation controller 508.

Figure 10:
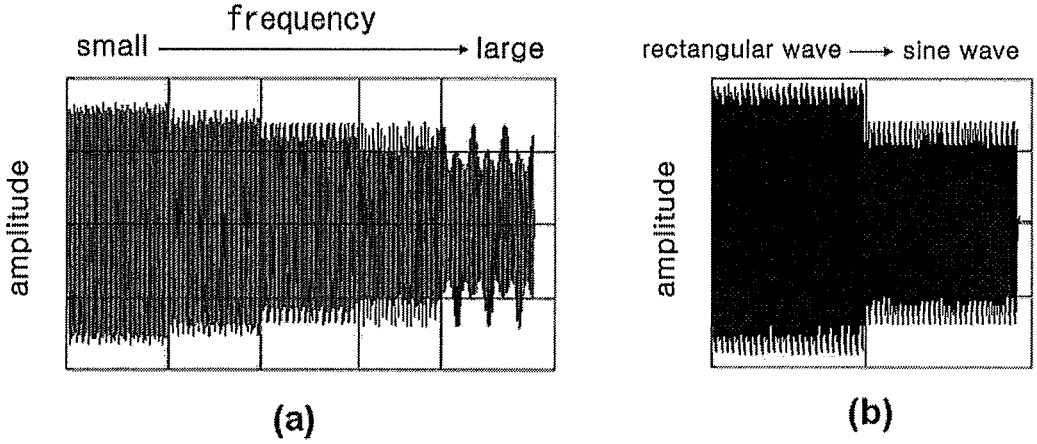
FIG. 10 is of graphs showing the amplitude of oscillation, wherein (a) is a graph showing the amplitude of oscillation as a function of oscillation frequency, and (b) is a graph showing the amplitude of oscillation as a function of a change in the waveform of the oscillations.

In the oscillation control apparatus of the present invention, the oscillation waveform is a sine wave, a rectangular wave or a triangular wave. As shown in FIG. 10, in the case of the sine wave, the amplitude can be reliably controlled, while as the oscillation frequency increases, the amplitude reduces, deteriorating the performance of control. On the other hand, unlike the sine wave, the rectangular wave and the triangular wave do not reduce the amplitude even if the oscillation frequency increases, but the control performance deteriorates if the oscillation frequency is low. Therefore, depending on casting conditions, an appropriate oscillation waveform must be selected.

Furthermore, the amplitude of the oscillation waveform used in the oscillation control apparatus of the present invention ranges from 10 μm to 1,500 μm, and the oscillation frequency ranges from 0.1 Hz to 20 Hz. The oscillation control apparatus is designed such that depending on casting conditions and the kind of a mixed skull, the amplitude and the oscillation frequency are controlled to within the above ranges.

Hereinafter, the method for controlling horizontal oscillation of the edge dam of the twin roll strip caster according to the present invention will be described in detail with reference to the attached drawings.

The method for controlling the horizontal oscillation of the edge dam of the twin roll strip caster according to the present invention includes a real time feedback control. Under the control of the control unit 501 which successively conducts the steps of a slow loop 506, the medium loop 505 and the fast loop 503, the servo valve 509 and the hydraulic cylinder 420 horizontally oscillate the oscillation plate 410 in accordance with an oscillation waveform having a predetermined amplitude and oscillation frequency that is applied from the control unit 501. Thereby, the refractory 150 of the edge dam that is coupled to the oscillation plate 410 is horizontally oscillated, thus eliminating a dead zone 200 that is a portion which is not affected by the oscillation, and reducing edge skull.

The steps of controlling the horizontal oscillation of the edge dam will be explained in detail. As shown in FIGS. 7 and 8, at step S1, information about the ON/OFF status of the oscillating operation, and the amplitude, frequency and waveform of oscillation is selected using the HMI monitor 510. Here, the HMI 510 exchanges information about the casting and the horizontal oscillation of the edge dam with the slow loop 506 of the control unit 501 once per second.

At step S2 (the step of the slow loop 506), the information about the oscillation of the edge dam that has been selected by the HMI monitor is received and transmitted to the medium loop 505.

At step S3 (the step of the medium loop 505), based on the information about the oscillation of the edge dam that has been received from the slow loop 506, reference values of the oscillation waveform having a predetermined amplitude and oscillation frequency that are required to control the horizontal oscillation of the edge dam are created in a period of 0.01 second. The reference values of the oscillation waveform are transmitted to the fast loop 503. At the step of the medium loop, to mitigate the impact that is caused by drastic changes in the amplitude and oscillation frequency of the reference generated in the oscillation waveform generator 512, oscillation waveform, the amplitude and oscillation frequency of the reference of the oscillation waveform are smoothly varied at constant rates, and then information about the reference of the oscillation waveform is transmitted to the fast loop 503.

At step S4 (the step of the fast loop 503), using both the information about the reference of the oscillation waveform that has been transmitted from the medium loop 505 and the information about the real-time position of the oscillation unit 400 that has been received from the oscillation-unit-displacement measuring device 460, an oscillation waveform having a predetermined amplitude and oscillation frequency that are required for the horizontal oscillation is applied to the servo valve 509 in a period of 0.001 second or less, thus controlling the hydraulic pressure in the hydraulic cylinder 420 of the oscillation unit 400. Thereby, the horizontal oscillation of the edge dam refractory is controlled based on the center as determined by the oscillation-unit-center measuring device 507 of the medium loop 505. Therefore, feedback control is conducted 1000 times or more per second, thus enhancing the precision of the oscillation control.

The operation of the oscillation unit of the oscillation control apparatus of the present invention will be described in detail. As shown in FIG. 6*d*, when oil is supplied into the hydraulic cylinder 420 through the first inlet line 430 of the main body 450, the cylinder rod 425 is moved to the right by the hydraulic pressure. Thereby, the oscillation plate 410 connected to the cylinder rod 425 by the supports 470 is also moved to the right, so that the edge dam refractory 150 coupled to the oscillation plate 410 is also moved to the right. In a related fashion, moving the edge dam refractory 150 to the left can be realized by supplying oil into the hydraulic cylinder 420 through the second inlet line 440 and moving the cylinder rod 425 to the left. Here, if the hydraulic cylinder 420 is controlled by the servo valve 509, the cylinder rod 425 is moved by the flow rate of oil supplied into the hydraulic cylinder 420, so that the amplitude, etc. can be controlled depending on casting conditions.

Figure 1:
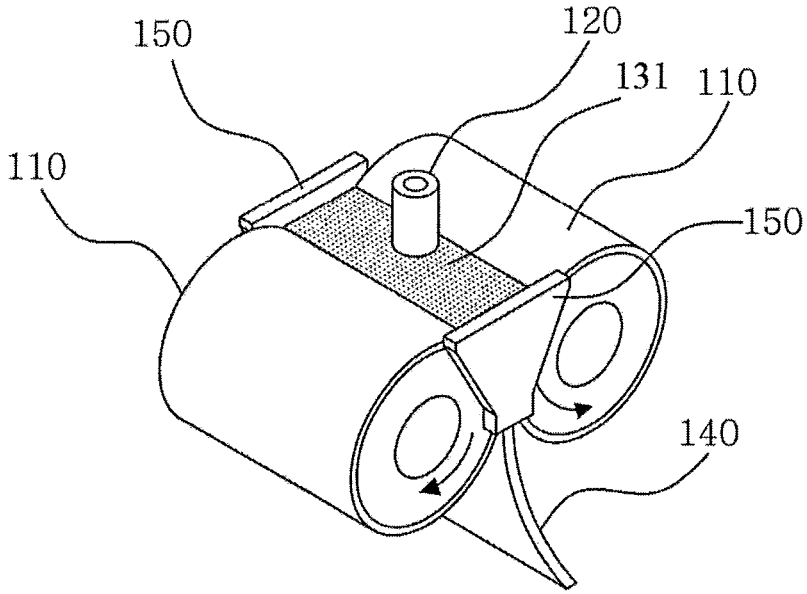
FIG. 1 is a perspective view of a typical twin roll strip caster.
Figure 2:
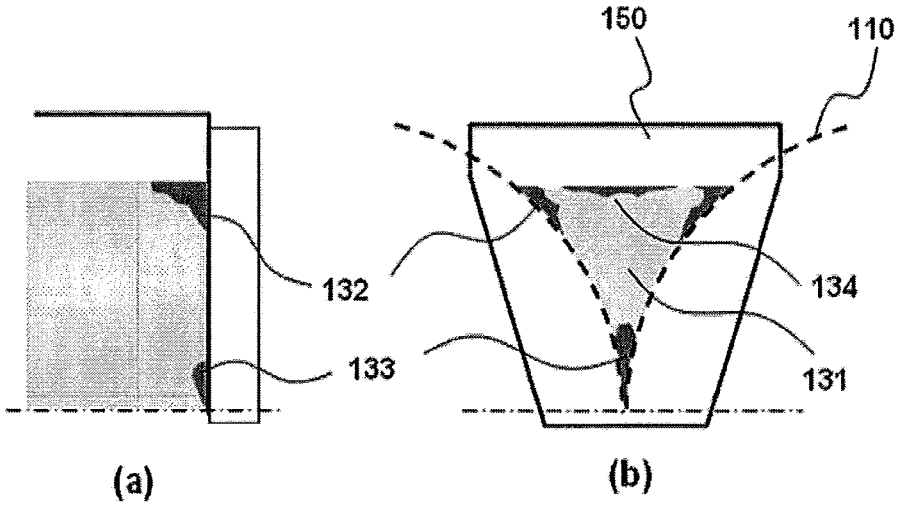
PRIOR ART FIG. 2
FIG. 2 is of schematic views showing skull formed in an edge dam according to a conventional technique.
Figure 3:
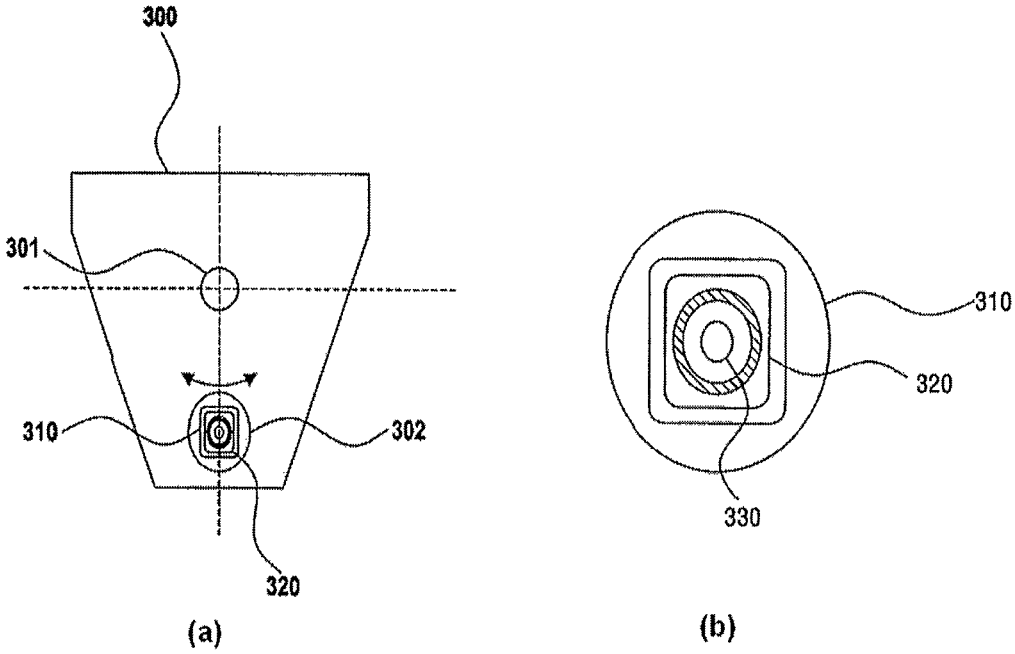
FIG. 3(*a*) is a front view of a conventional edge dam oscillating device, and FIG. 3(*b*) is an enlarged view of a critical portion.
Figure 4:
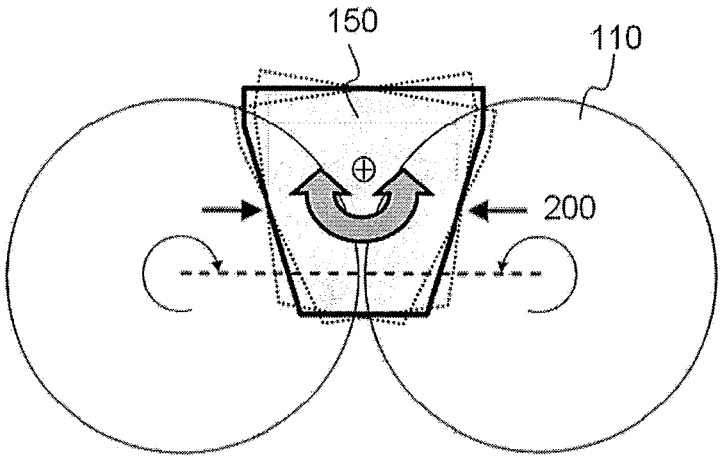
FIG. 4(*a*) is a schematic view showing an oscillation form of the conventional edge dam oscillating device, and FIG. 4(*b*) is a schematic view showing an oscillation form of an edge dam oscillating device according to the present invention.
Figure 4:
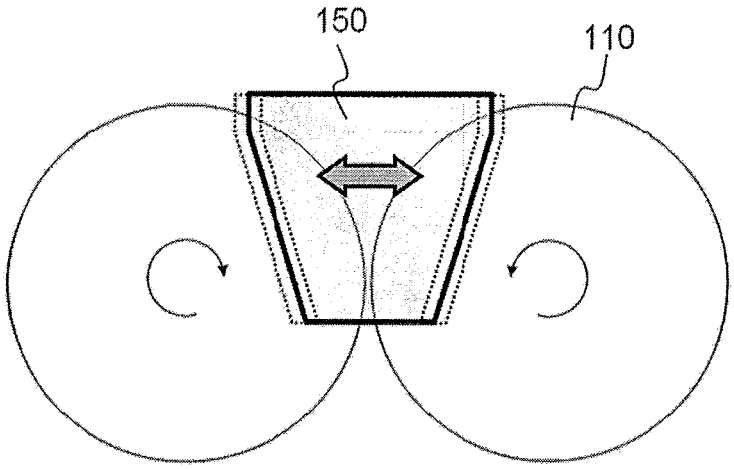
Figure 5:
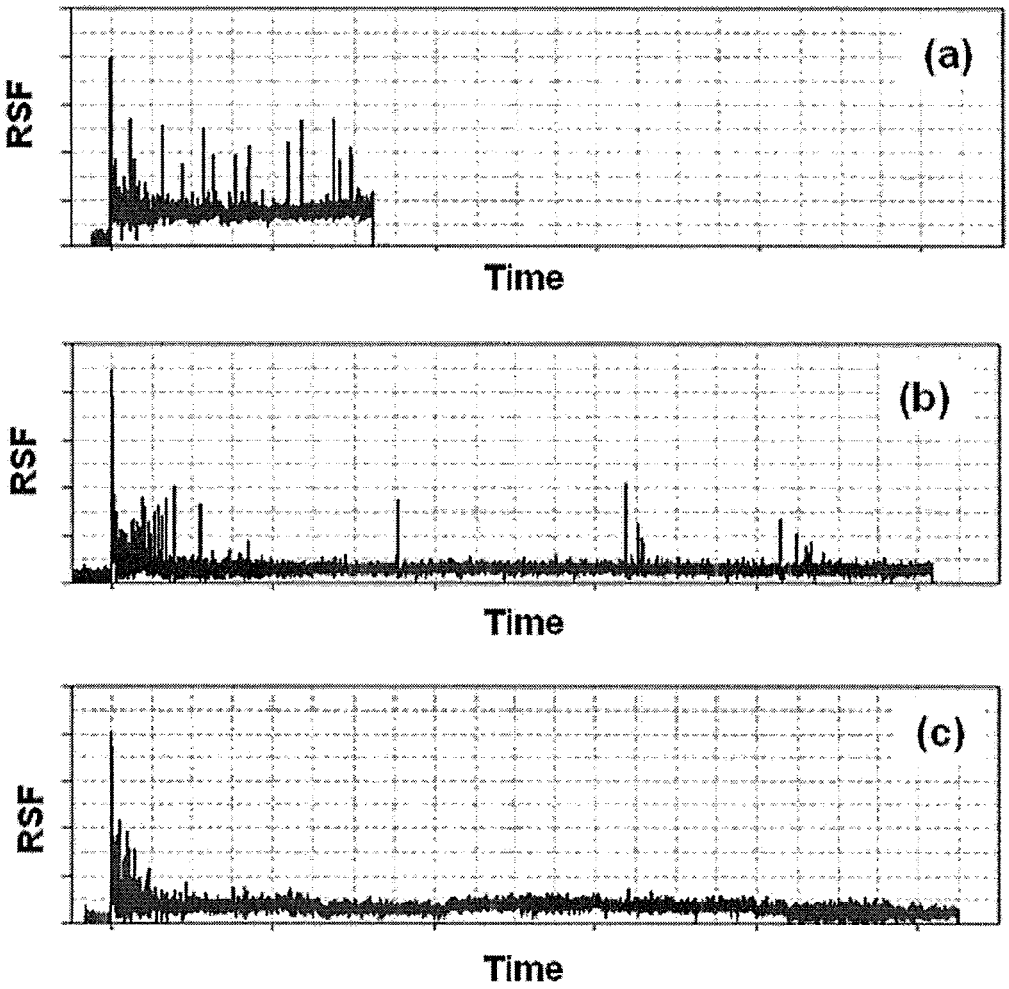
FIG. 5 is of graphs illustrating the extent of mixture of the skull as functions of the oscillation ON/OFF of the edge dam and the oscillation method, wherein (a) illustrates when it does not oscillate, (b) illustrates the conventional method, and (c) illustrates the method according to the present invention.
Figure 9:
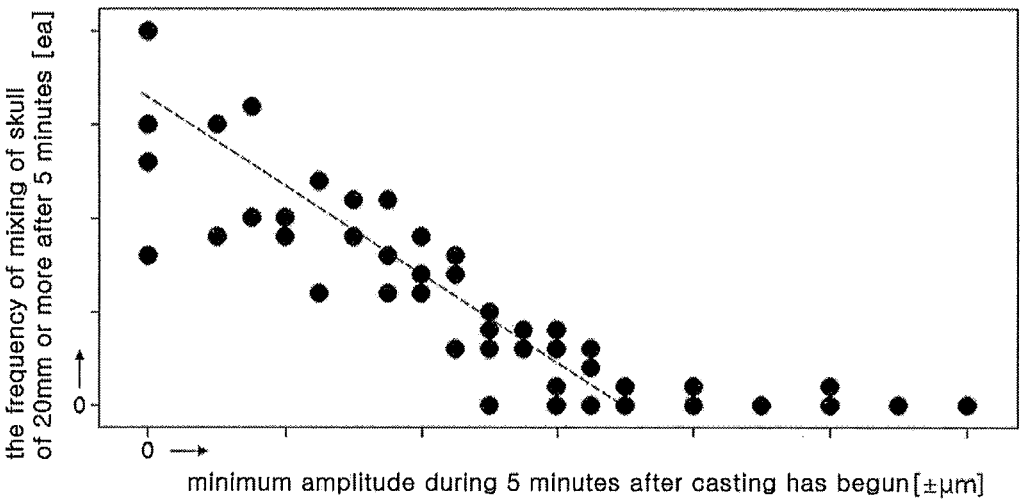
FIG. 9 is a graph showing the amplitude of oscillation at an initial stage of casting and the frequency of mixture of skull.

Meanwhile, as shown in FIG. 5, in a twin roll type strip casting process, at the initial stage of casting when the casting is not yet stabilized, heat loss of the molten steel through the edge dam refractory causes a lot of skull. To remove such skull, it is required to impart the amplitude of the oscillation waveform with a large value. FIG. 9 is a graph showing the frequency of mixture of skull as a function of the amplitude of oscillation at the initial stage of casting. It can be appreciated that at the initial stage of casting, as the amplitude of oscillation increases, the frequency of mixture of skull is reduced. Therefore, in the oscillation control method according to the present invention, at the initial stage when the casting is not yet stabilized, the amplitude of oscillation is controlled such that it is maintained to be comparatively large, in detail, to be within the range of from 500 μm to 1,200 μm. The reason for this is because if the amplitude of oscillation is less than 500 μm at the initial stage of the casting, formed skull is continuously mixed with a casting strip for a fairly long time after the casting has begun, rather than being rapidly removed, thus deteriorating the quality of the casting strip, and if the amplitude of oscillation is greater than 1,200 μm, the stability of the edge dam refractory may not be ensured, or the edge dam refractory may be worn, reducing its lifetime.

After the initial stage of the casting has passed, and the stage is one in which the casting has stabilized, it is required to suppress the generation and growth of skull. If the amplitude of oscillation is kept large so as to achieve the above purpose, there is the likelihood of the edge dam being damaged by excessive oscillation during the casting. Further, if the amplitude of oscillation is large for a comparatively long time, abnormal wear of the edge dam is caused, thus deteriorating the quality of the edges of the casting strip, or reducing the lifetime of the edge dam refractory. Hence, after the initial stage of the casting has passed, at the stage in which most of skull that had been at the initial stage of the casting has been removed, the amplitude of oscillation must be maintained to be as small as possible within a range that can prevent damage or abnormal wear of the edge dam and mitigate the generation and growth of skull. To achieve this, after the initial stage of casting, the amplitude of oscillation must be maintained within a range from 200 μm to 600 μm because if the amplitude of oscillation is less than 200 μm, the generation and growth of skull cannot be effectively suppressed, and if the amplitude of oscillation is greater than 600 μm, there may be abnormal wear of the edge dam.

At a final stage of the casting, the temperature of the molten steel decreases, thus increasing the possibility of skull generation and growth. Therefore, it is required to increase the amplitude of oscillation to suppress the generation and growth of skull. Given this, at the final stage of the casting, it is preferable for the amplitude of oscillation to be maintained within a range from 400 μm to 700 μm. The reason for this is because if the amplitude of oscillation is less than 400 μm, it is difficult to suppress the generation of skull which may be caused by a decrease in the temperature of the molten steel, and if the amplitude of oscillation is greater than 700 μm, a lower portion of the edge dam is worn, causing damage, such as a deep nick, to the edge.

As stated above, if the amplitude of oscillation is increased, there is a likelihood of the edge dam being damaged. Given this, as shown in FIG. 10, reducing the oscillation frequency of the waveform or changing the waveform from a sine wave into a rectangular or triangular wave is needed so that the amplitude of oscillation can be minutely controlled, thus minimizing the possibility of the edge dam being damaged while increasing the amplitude of oscillation.

Actually, in the results of the most general three kinds of tests on the extent of mixture of skull as functions of the ON/OFF status of the oscillation of the edge dam and the oscillation method, as shown FIG. 5(*a*), it can be appreciated that if the edge dam does not oscillate, the mixture of skull is continuously induced, which renders casting impossible after a predetermined time has passed. As shown in FIG. 5(*b*), in the case where the edge dam was mechanically oscillated using the conventional oscillation cam, the mixture of skull was reduced compared to the case of FIG. 5(*a*), but because of the presence of a dead zone, when the temperature of molten steel is reduced, for example, at the time of replacement of a ladle or at the final stage of the casting, the mixing of skull was observed. As shown in FIG. 5(*c*), when the horizontal oscillation method of the present invention was used, all sides of the edge dam refractory uniformly oscillated, so that not only skull that formed at the initial stage of the casting could be continuously removed, but also there was no dead zone. Thus, the mixing of skull was not observed even at the time of replacement of the ladle or in the final stage of the casting.

Eventually, in the method of controlling the horizontal oscillation of the edge dam according to the present invention, the servo valve and the hydraulic cylinder horizontally oscillate the edge dam refractory in accordance with an oscillation waveform having a predetermined amplitude and oscillation frequency that is applied thereto from the control unit, thus eliminating the dead zone 200 which is a portion that does not oscillate. Further, depending on casting conditions, the amplitude, oscillation frequency and the oscillation waveform are variably controlled. Therefore, skull that has been formed at the initial stage of the casting can be rapidly removed, the generation and growth of skull can be suppressed, and damage to the casting roll or edge dam can be prevented, so that the stability of casting can be ensured and the quality of a produced casting strip can be improved.

The invention claimed is:

1. An apparatus for controlling horizontal oscillation of an edge dam of a twin roll strip caster, the apparatus comprising:

an oscillation unit horizontally oscillating an oscillation plate in accordance with an oscillation waveform so that an edge dam refractory coupled to the oscillation plate horizontally oscillates;

a servo valve outputting the oscillation waveform to the oscillation unit to perform the horizontal oscillation; and a control unit applying the oscillation waveform to the servo valve, thus controlling the horizontal oscillation of the oscillation unit, wherein the control unit comprises:

an oscillation information collector collecting from an HMI (Human Machine Interface) information about an ON/OFF status of the oscillation, and an amplitude, a frequency and a waveform of the oscillation;

an oscillation waveform generator generating, using the information received from the oscillation information collector, a reference of the oscillation waveform having an amplitude and a frequency that are required to control the horizontal oscillation; and a horizontal oscillation controller controlling the servo valve both using the information about the oscillation waveform received from the oscillation waveform generator and using information about a position of the oscillation unit that is received from an oscillation-unit-displacement measuring device, thus controlling the horizontal oscillation of the oscillation unit.

2. The apparatus for controlling the horizontal oscillation of the edge dam of the twin roll strip caster according to claim 1, wherein the oscillation unit comprises:

a main body installed with a hydraulic line;

a hydraulic cylinder fastened to the main body;

a cylinder rod placed through the hydraulic cylinder so as to be movable to opposite sides of the hydraulic cylinder; and a support connecting opposite ends of the cylinder rod to opposite ends of the oscillation plate.

3. The apparatus for controlling the horizontal oscillation of the edge dam of the twin roll strip caster according to claim 1, wherein the control unit further comprises a ramping unit varying at constant rates the amplitude and the frequency of the reference of the oscillation waveform generated from the oscillation waveform generator.

4. The apparatus for controlling the horizontal oscillation of the edge dam of the twin roll strip caster according to claim 3, wherein the amplitude of the oscillation waveform ranges from 10 μm to 1,500 μm, and the frequency ranges from 0.1 Hz to 20 Hz.

5. The apparatus for controlling the horizontal oscillation of the edge dam of the twin roll strip caster according to claim 1, wherein the control unit further comprises an oscillation-unit-center measuring device transmitting information about a center position of the oscillation unit to the horizontal oscillation controller.

6. The apparatus for controlling the horizontal oscillation of the edge dam of the twin roll strip caster according to claim 1, wherein the oscillation-unit-displacement measuring device transmits information about a real time position of the oscillation unit to the control unit.

7. The apparatus for controlling the horizontal oscillation of the edge dam of the twin roll strip caster according to claim 6, wherein the oscillation waveform comprises a sine wave, a rectangular wave or a triangular wave.

8. The apparatus for controlling the horizontal oscillation of the edge dam of the twin roll strip caster according to claim 6, wherein the amplitude of the oscillation waveform ranges from 10 μm to 1,500 μm, and the frequency ranges from 0.1 Hz to 20 Hz.

9. The apparatus for controlling the horizontal oscillation of the edge dam of the twin roll strip caster according to claim 1, wherein the oscillation waveform comprises a sine wave, a rectangular wave or a triangular wave.

10. The apparatus for controlling the horizontal oscillation of the edge dam of the twin roll strip caster according to claim 9, wherein the amplitude of the oscillation waveform ranges from 10 μm to 1,500 μm, and the frequency ranges from 0.1 Hz to 20 Hz.

11. The apparatus for controlling the horizontal oscillation of the edge dam of the twin roll strip caster according to claim 1, wherein the amplitude of the oscillation waveform ranges from 10 μm to 1,500 μm, and the frequency ranges from 0.1 Hz to 20 Hz.

12. A method for controlling horizontal oscillation of an edge dam of a twin roll strip caster, the method comprising horizontally oscillating an oscillation plate using a servo valve and a cylinder in accordance with an oscillation waveform so that an edge dam refractory coupled to the oscillation plate horizontally oscillates, thus eliminating a zone which does not oscillate, and reducing edge skull, wherein the horizontally oscillating comprises:

an operation of selecting information about an ON/OFF status of the oscillation, and an amplitude, a frequency and a waveform of the oscillation using an HMI (Human Machine Interface) monitor;

a slow loop operation of collecting the information selected using the HMI monitor and transmitting the information to a medium loop;

a medium loop operation of generating, using the information received from the slow loop, a reference of the oscillation waveform having an amplitude and a frequency that are required to control the horizontal oscillation, and transmitting the reference to a fast loop; and a fast loop operation of controlling the servo valve both using the information about the reference of the oscillation waveform received from the medium loop and using information about a position of an oscillation unit received from an oscillation-unit-displacement measuring device, thus controlling horizontal oscillation of the oscillation unit.

13. The method for controlling the horizontal oscillation of the edge dam of the twin roll strip caster according to claim 12, wherein the horizontally oscillating further comprises horizontally oscillating the oscillation plate such that at an initial stage of casting, an amplitude of the oscillation is maintained within a range from 500 μm to 1,200 μm, and after the initial stage has passed, the amplitude is maintained within a range from 200 μm to 600 μm, and at a final stage of the casting, the amplitude is maintained within a range from 400 μm to 700 μm.

14. The method for controlling the horizontal oscillation of the edge dam of the twin roll strip caster according to claim 13, further comprising reducing the frequency of the oscillation waveform or changing the oscillation waveform from a sine wave into a rectangular or triangular wave, thus minutely controlling the amplitude of the oscillation waveform.

15. The method for controlling the horizontal oscillation of the edge dam of the twin roll strip caster according to claim 12, further comprising reducing the frequency of the oscillation waveform or changing the oscillation waveform from a sine wave into a rectangular or triangular wave, thus minutely controlling the amplitude of the oscillation waveform.

16. The method for controlling the horizontal oscillation of the edge dam of the twin roll strip caster according to claim 12, wherein the medium loop operation comprises varying the amplitude and frequency of the reference of the oscillation waveform at constant rates, and transmitting the information about the reference of the oscillation waveform to the fast loop.

17. The method for controlling the horizontal oscillation of the edge dam of the twin roll strip caster according to claim 12, wherein the fast loop operation comprises controlling the horizontal oscillation of the oscillation unit in a period of 0.001 or less.

* * * * *